US008414312B2

(12) United States Patent
Hung et al.

(10) Patent No.: US 8,414,312 B2
(45) Date of Patent: Apr. 9, 2013

(54) GROUNDING A DOCKING STATION WITH A HOST DEVICE USING GROUNDING LAYERS OF MULTILAYER PRINTED CIRCUIT BOARDS

(75) Inventors: Chin-Chung Hung, New Taipei (TW); Yu-Jen Li, New Taipei (TW); Tsung-Jen Su, New Taipei (TW)

(73) Assignee: Wistron Corporation, Xizhi Dist., New Taipei (TW)

( * ) Notice: Subject to any disclaimer, the term of this patent is extended or adjusted under 35 U.S.C. 154(b) by 0 days.

(21) Appl. No.: 13/213,067

(22) Filed: Aug. 18, 2011

(65) Prior Publication Data

US 2012/0071013 A1 Mar. 22, 2012

(30) Foreign Application Priority Data

Sep. 16, 2010 (TW) ..... 99217945 U

(51) Int. Cl.
*H01R 4/66* (2006.01)

(52) U.S. Cl. ..... 439/108

(58) Field of Classification Search ..... 439/188, 439/108, 181, 88, 92, 289
See application file for complete search history.

(56) References Cited

U.S. PATENT DOCUMENTS

| | | | | |
|---|---|---|---|---|
| 6,379,183 | B1 * | 4/2002 | Ayres et al. | 439/578 |
| 6,461,181 | B1 * | 10/2002 | Goh et al. | 439/289 |
| 6,648,661 | B1 * | 11/2003 | Byrne et al. | 439/188 |
| 7,556,521 | B2 * | 7/2009 | Abram | 439/341 |
| 7,751,853 | B2 * | 7/2010 | Fadell et al. | 455/557 |
| 8,050,714 | B2 * | 11/2011 | Fadell et al. | 455/557 |
| 2001/0031578 | A1 * | 10/2001 | Usui et al. | 439/607 |
| 2005/0026499 | A1 * | 2/2005 | Choi | 439/607 |
| 2008/0038963 | A1 * | 2/2008 | Hirokawa | 439/676 |
| 2008/0123285 | A1 * | 5/2008 | Fadell et al. | 361/686 |
| 2009/0156060 | A1 * | 6/2009 | Hunkins | 439/638 |
| 2011/0045706 | A1 * | 2/2011 | Hunkins | 439/660 |

* cited by examiner

*Primary Examiner* — Chandrika Prasad
(74) *Attorney, Agent, or Firm* — Winston Hsu; Scott Margo

(57) ABSTRACT

A connector structure includes a first connector installed on a host device. The first connector includes a first base, a first terminal set installed on the first base, and a first grounding component installed on the first base. The connector structure further includes a second connector installed on a docking station for connecting with the first connector. The second connector includes a second base, a second terminal set installed on the second base for contacting with the first terminal set so as to transmit signals between the host device and the docking station with the first terminal set when the host device is docked in the docking station, and a second grounding component installed on the second base for contacting with the first grounding component so as to ground with the first grounding component when the host device is docked in the docking station.

6 Claims, 6 Drawing Sheets

GROUNDING A DOCKING STATION WITH A HOST DEVICE USING GROUNDING LAYERS OF MULTILAYER PRINTED CIRCUIT BOARDS

BACKGROUND OF THE INVENTION

1. Field of the Invention

The invention relates to a connector structure and a computer system with grounding function, and more particularly, to a connector structure and a computer system capable of grounding a docking station with a host device.

2. Description of the Prior Art

For expanding functions of a notebook computer in the market, a conventional docking station for docking with the notebook computer is available to provide various interfaces to connect to peripheral devices. The notebook computer can apply the peripheral devices as a desktop computer when connecting to the docking station; and the notebook computer can be a portable device when separating from the docking station. However, electrostatic discharging protection of a computer device is an important issue in use of some areas with dry weather. For example, when a notebook computer is used in a dry surrounding, static electricity is easily transmitted from hands of a user to electronic components disposed inside the notebook computer. As the notebook computer does not have electrostatic protecting function, the electronic components may be damaged by the static electricity. In the prior art, some electrostatic discharging components are disposed on the notebook computer and its docking station, and some holes are formed on the covering components to make electrostatic discharging components protrude out for enhancing effect of electrostatic discharging protection. It has drawbacks of long labor hours, large assembly tolerance, expensive manufacturing cost, and affecting preferable aesthetic appearance. Thus, design of a grounding mechanism with a simple structure for providing grounding function and electrostatic discharge protection preferably is an important issue in the mechanical design industry.

SUMMARY OF THE INVENTION

The present invention provides a connector structure and a computer system capable of grounding a docking station with a host device to solve the problems mentioned above.

According to the claimed invention, a connector structure includes a first connector and a second connector. The first connector is installed on a host device. The first connector includes a first base; a first terminal set installed on the first base; and a first grounding component installed on the first base. The second connector is installed on a docking station for connecting with the first connector. The second connector includes a second base; a second terminal set installed on the second base for contacting with the first terminal set so as to transmit signals between the host device and the docking station with the first terminal set when the host device is docked in the docking station; and a second grounding component installed on the second base for contacting with the first grounding component so as to ground with the first grounding component when the host device is docked in the docking station.

According to the claimed invention, the first grounding component is a plate-shaped structure made of metal material for engaging with the first base.

According to the claimed invention, the second grounding component includes a plurality of metal clip structures protruding out of the second base for abutting against the first grounding component.

According to the claimed invention, the first connector further includes a circuit board installed on the first base, a grounding end of the circuit board electrically connected to the first grounding component; and a cable electrically connected to the grounding end of the circuit board and a grounding end of the host device so as to ground the first grounding component with the grounding end of the host device.

According to the claimed invention, the second connector further includes a circuit board installed on the second base, a grounding end of the circuit board electrically connected to the second grounding component; and a cable electrically connected to the grounding end of the circuit board and a grounding end of the docking station so as to ground the second grounding component with the grounding end of the docking station.

According to the claimed invention, the second terminal set is a pogo pin set.

According to the claimed invention, at least one positioning hole is formed on the first base and at least one positioning post is formed on the second base for inserting inside the positioning hole of the first base so as to fix the first connector with the second connector.

According to the claimed invention, a computer system includes a docking station, a host device and a connector structure. The docking station includes a grounding end. The host device is docked in the docking station in a detachable manner. The host device includes a grounding end. The connector structure is for transmitting signals between the docking station and the host device. The connector structure includes a first connector and a second connector. The first connector is installed on the host device. The first connector includes a first base; a first terminal set installed on the first base; and a first grounding component installed on the first base. The second connector is installed on the docking station for connecting with the first connector. The second connector includes a second base; a second terminal set installed on the second base for contacting with the first terminal set so as to transmit signals between the host device and the docking station with the first terminal set when the host device is docked in the docking station; and a second grounding component installed on the second base for contacting with the first grounding component so as to ground with the first grounding component when the host device is docked in the docking station.

The present invention utilizes the grounding components contacting with each other so as to ground the host device with the docking station when the host device is docked in the docking station, such that an extra electrostatic discharging component is not needed, and there is no need to form holes on the covering components to make electrostatic discharging components protrude out, resulting in affecting preferable aesthetic appearance. Furthermore, the host device and the docking station are grounded with each other to improve the issue of electromagnetic interference and to protect the connector structure from electrostatic interference, such that the grounding mechanism of the present invention provides the preferable electrostatic discharge protection and electromagnetic interference protection without drawbacks of long labor hours, large assembly tolerance, expensive manufacturing cost, and affecting preferable aesthetic appearance.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
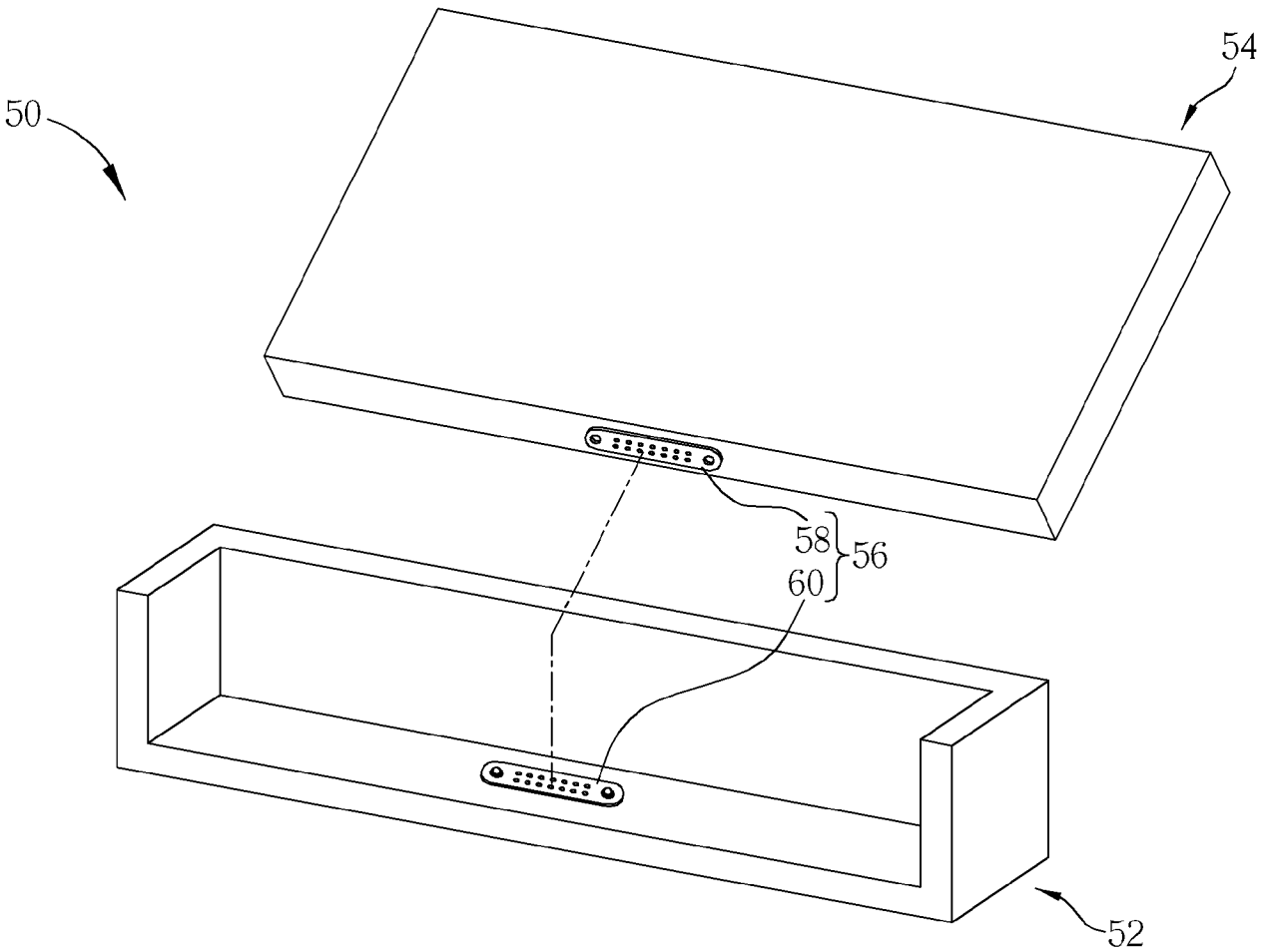
FIG. 1 is a schematic diagram of a computer system according to a preferred embodiment of the present invention.

Please refer to FIG. 1. FIG. 1 is a schematic diagram of a computer system 50 according to a preferred embodiment of the present invention. The computer system 50 includes a docking station 52 and a host device 54. The host device 54 can be a portable computer, such as a notebook computer and so on. The host device 54 is docked in the docking station 52 in a detachable manner. The docking station 52 for docking with the host device 54 provides various interfaces to connect to peripheral devices so as to expand the functions of the host device 54. The host device 54 can apply the peripheral devices as a desktop computer when connecting to the docking station 52; and the host device 54 can be a portable device when separating from the docking station 52. Besides, the computer system 50 includes a connector structure 56 for transmitting signals between the docking station 52 and the host device 54. The connector structure 56 includes a first connector 58 and a second connector 60. The first connector 58 is installed on the host device 54. The second connector 60 is installed on the docking station 52 for connecting with the first connector 58 when the host device 54 is docked in the docking station 52.

Figure 2:
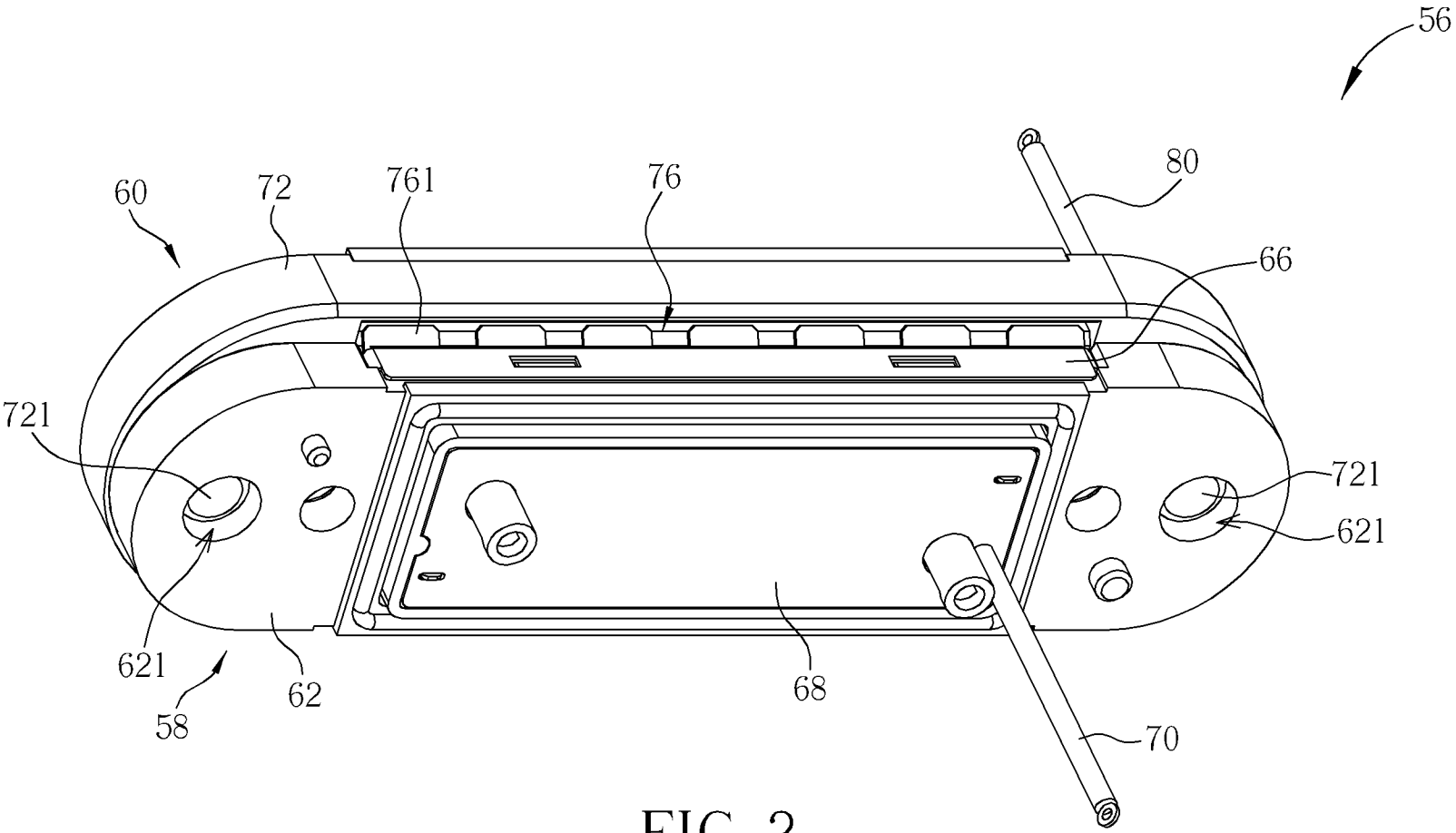
FIG. 2 is a schematic diagram illustrating combination of a first connector and a second connector according to the preferred embodiment of the present invention.
Figure 3:
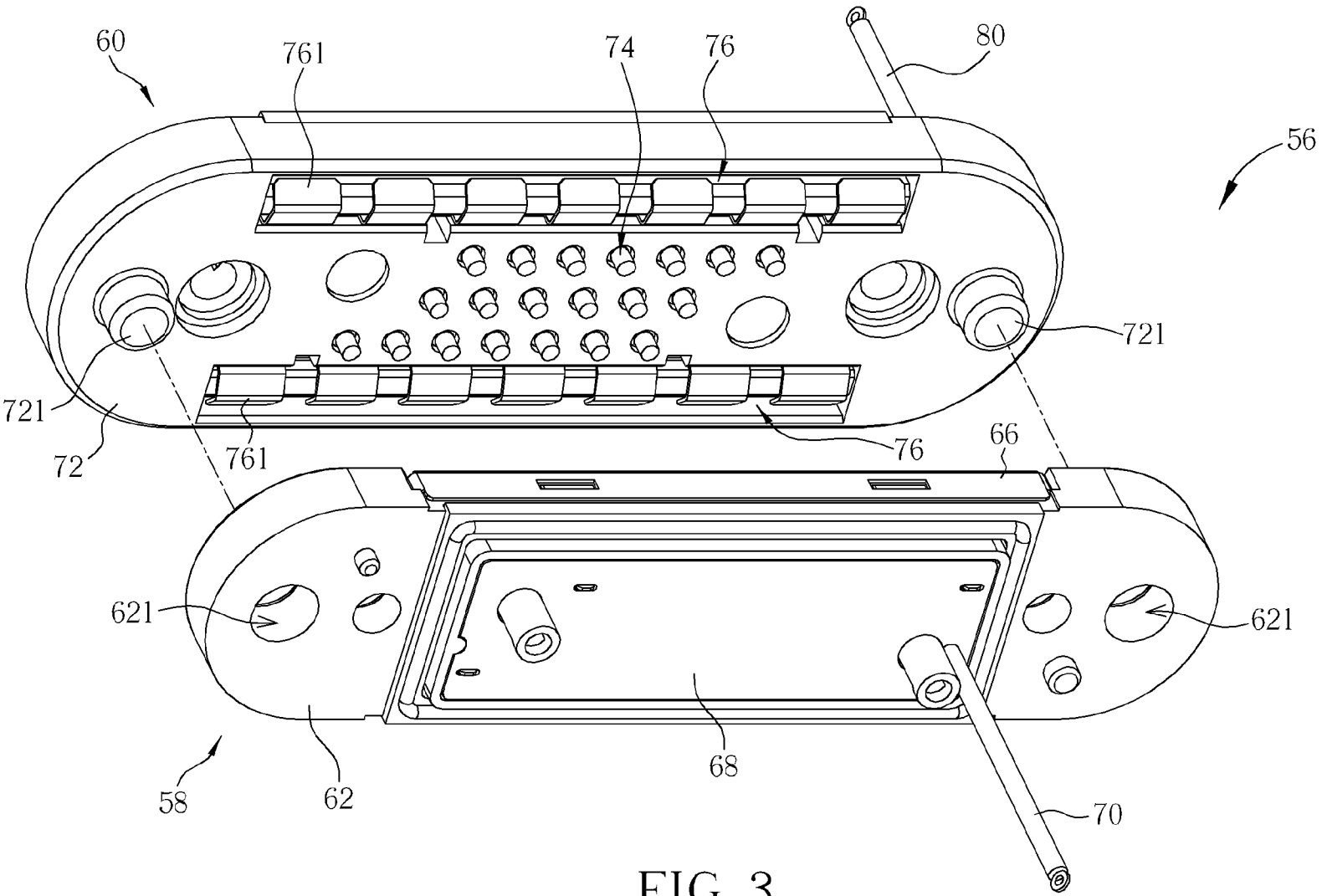
FIG. 3 is a schematic diagram illustrating separation of the first connector and the second connector according to the preferred embodiment of the present invention.
Figure 4:
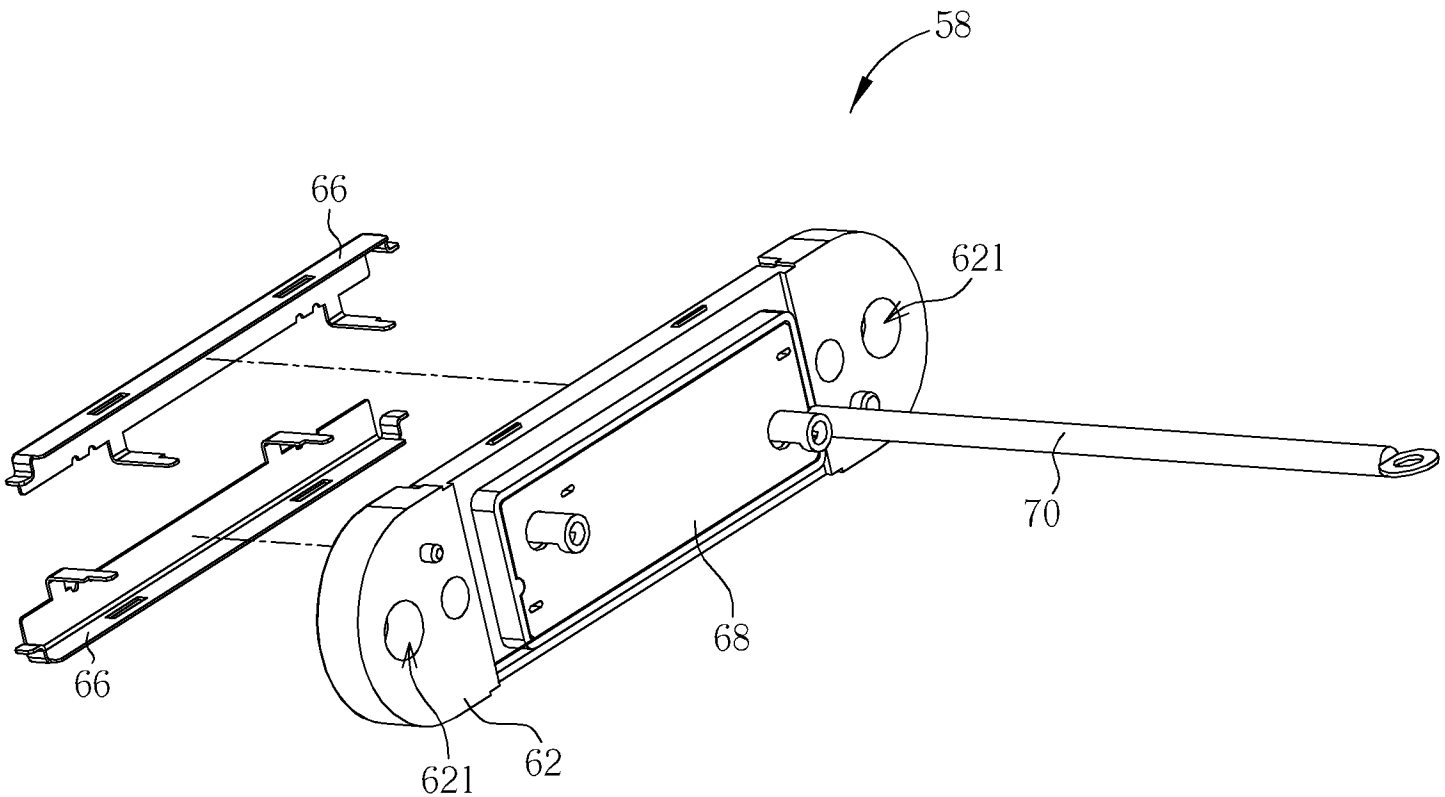
FIG. 4 is an exploded diagram of the first connector according to the preferred embodiment of the present invention.
Figure 5:
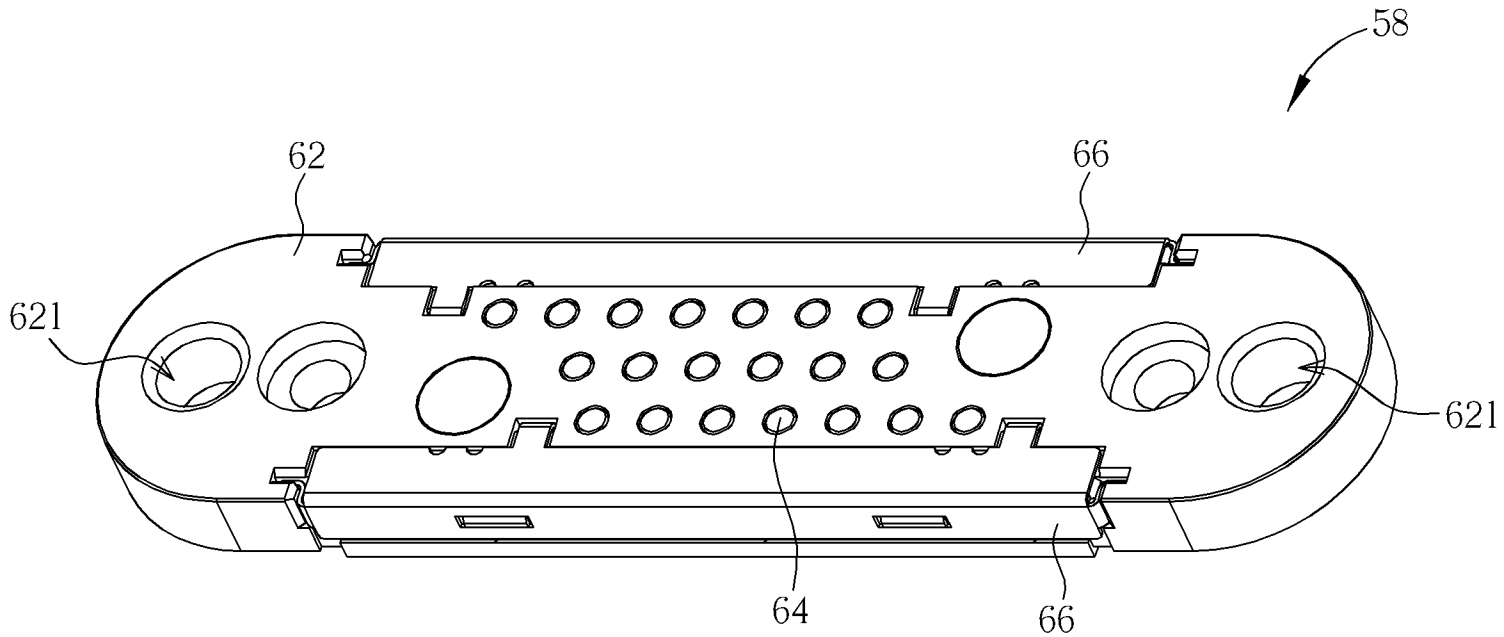
FIG. 5 is a schematic diagram of the first connector according to the preferred embodiment of the present invention.
Figure 6:
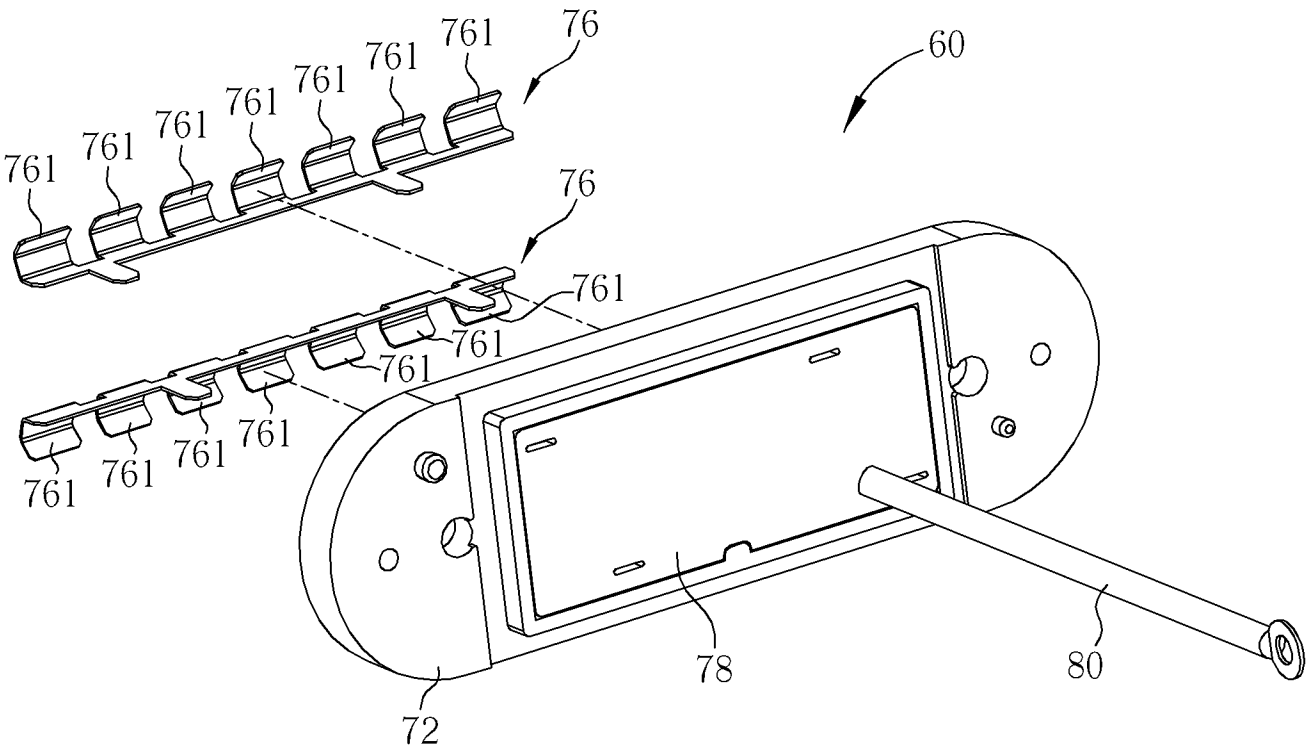
FIG. 6 is an exploded diagram of the second connector according to the preferred embodiment of the present invention.

Please refer to FIG. 2 to FIG. 6. FIG. 2 is a schematic diagram illustrating combination of the first connector 58 and the second connector 60 according to the preferred embodiment of the present invention. FIG. 3 is a schematic diagram illustrating separation of the first connector 58 and the second connector 60 according to the preferred embodiment of the present invention. FIG. 4 is an exploded diagram of the first connector 58 according to the preferred embodiment of the present invention. FIG. 5 is a schematic diagram of the first 58 connector according to the preferred embodiment of the present invention. FIG. 6 is an exploded diagram of the second connector 60 according to the preferred embodiment of the present invention. The first connector 58, installed on the host device 54, includes a first base 62, a first terminal set 64, and at least one first grounding component 66. At least one positioning hole 621 is formed on the first base 62. The first terminal set 64 is installed on the first base 62. The first grounding component 66 is installed on the first base 62. The first grounding component 66 can be a plate-shaped structure made of metal material for engaging with the first base 62. Furthermore, the first connector 58 includes a circuit board 68 installed on the first base 62. A grounding end of the circuit board 68 is electrically connected to the first grounding component 66. For example, the circuit board 68 can be a multilayer printed circuit board, and the first grounding component 66 is electrically connected to a grounding layer of the circuit board 68. The first connector 58 includes a cable 70 electrically connected to the grounding end of the circuit board 68 and a grounding end of the host device 54 so as to ground the first grounding component 66 with the grounding end of the host device 54. The grounding mechanism between the first grounding component 66 and the host device 54 is not limited to wires. For example, the grounding layer of the circuit board 68 can be designed to ground with a grounding terminal of the first terminal set 64. The grounding terminal of the first terminal set 64 is electrically connected to the grounding end of the host device 54, and the first grounding component 66 is electrically connected to the grounding layer of the circuit board 68, such that the effect of the first grounding component 66 grounding with the grounding end of the host device 54 can be achieved as well.

On the other hand, the second connector 60 installed on the docking station 52 includes a second base 72, a second terminal set 74, and at least one second grounding component 76. The second terminal set 74 is installed on the second base 72. The second grounding component 76 is installed on the second base 72. The positioning post 721 is formed on the second base 72 for inserting inside the positioning hole 621 of the first base 62 so as to fix the first connector 58 with the second connector 60. The second terminal set 74 contacts with the first terminal set 64 so as to transmit signals between the host device 54 and the docking station 52 with the first terminal set 64 when the host device 54 is docked in the docking station 52. The second terminal set 74 can be a pogo pin set and so on. The second grounding component 76 contacts with the first grounding component 66 so as to ground with the first grounding component 66 when the host device 54 is docked in the docking station 52. Besides, the second grounding component 76 is engaged with the second base 72. The second grounding component 76 can include a plurality of metal clip structures 761 protruding out of the second base 72 for abutting against the first grounding component 66 so as to enhance contacting effect between the first grounding component 66 and the second grounding component 76. Furthermore, the second connector 60 includes a circuit board 78 installed on the second base 72. A grounding end of the circuit board 78 is electrically connected to the second grounding component 76. For example, the circuit board 78 can be a multilayer printed circuit board, and the second grounding component 76 is electrically connected to a grounding layer of the circuit board 78. The second connector 60 includes a cable 80 electrically connected to the grounding end of the circuit board 78 and a grounding end of the docking station 52 so as to ground the second grounding component 76 with the grounding end of the docking station 52. The grounding mechanism between the second grounding component 76 and the docking station 52 is not limited to wires. For example, the grounding layer of the circuit board 78 can be designed to ground with the grounding terminal of the second terminal set 74, the grounding terminal of the second terminal set 74 is electrically connected to the grounding end of the docking station 52, and the second grounding component 76 is electrically connected to the grounding layer of the circuit board 78, such that the effect of the second grounding component 76 grounding with the grounding end of the docking station 52 can be achieved as well.

When the host device 54 is docked in the docking station 52, the first connector 58 is engaged with the second connector 60, as shown in FIG. 2. At the same time, the positioning post 721 of the second base 72 is inserted inside the positioning hole 621 of the first base 62 so as to fix the first connector 58 with the second connector 60. Simultaneously, the first terminal set 64 contacts with the second terminal set 74 so as to transmit signals between the host device 54 and the docking station 52. It should be mentioned that the first grounding component 66 of the first connector 58 grounds with the second grounding component 76 of the second connector 60 when the first connector 58 is engaged with the second connector 60, especially the metal clip structures 761 of the second grounding component 76 resiliently abut against the first grounding component 66 so as to enhance the contacting effect between the first grounding component 66 and the second grounding component 76, such that the first grounding component 66 grounds with the second grounding component 76 stably. The structural design of the first grounding component 66 and the second grounding component 76 is not limited to the present embodiment, for example, the first grounding component 66 can include a plurality of metal clip structures and the second grounding component 76 is a plate-shaped structure made of metal material, and it depends on actual design demand. Since the first grounding component 66 is electrically connected to the grounding end of the host device 54 via connection of the cable 70 and the grounding end of the circuit board 68, and the second grounding component 76 is electrically connected to the grounding end of the docking station 52 via connection of the cable 80 and the grounding end of the circuit board 78, the host device 54 is grounded with the docking station by the interconnection between the first grounding component 66 and the second grounding component 76, so as to provide the preferable electrostatic discharge protection and electromagnetic interference protection to the computer system 50. Besides the grounding path mentioned above, a grounding terminal can be designed in the first terminal set 64 or in the second terminal set 74 of the present invention for respectively connecting to the grounding end of the host device 54 or the grounding end of the docking station 52. The grounding terminal of the first terminal set 64 and the grounding terminal of the second terminal set 74 are electrically connected to the first grounding component 66 and the second grounding component 76 via the grounding layer of the circuit board 68 and the grounding layer of the circuit board 78 respectively, so as to provide another grounding path. As mentioned above, all the grounding mechanism of interconnection between the grounding end of the host device 54, the first grounding component 66 of the first connector 58, the grounding component 66 of the first connector 58 and the grounding end of the docking station 52, is within the scope of the present invention.

In contrast to the prior art, the present invention utilizes the grounding components contacting with each other so as to ground the host device with the docking station when the host device is docked in the docking station, such that an extra electrostatic discharging component is not needed, and there is no need to form holes on the covering components to make electrostatic discharging components protrude out, resulting in affecting preferable aesthetic appearance. Furthermore, the host device and the docking station are grounded with each other to improve the issue of electromagnetic interference and to protect the connector structure from electrostatic interference, such that the grounding mechanism of the present invention provides the preferable electrostatic discharge protection and electromagnetic interference protection without drawbacks of long labor hours, large assembly tolerance, expensive manufacturing cost, and affecting preferable aesthetic appearance.

Those skilled in the art will readily observe that numerous modifications and alterations of the device and method may be made while retaining the teachings of the invention.

What is claimed is:

1. A connector structure comprising:

a first connector installed on a host device, the first connector comprising:

a first base;

a first terminal set installed on the first base, the first terminal set comprising a first grounding terminal electrically connected to a grounding end of the host device;

a first grounding component installed on the first base, the first grounding component being a plate-shaped structure made of metal material for engaging with the first base; and a first multilayer printed circuit board installed on the first base, a grounding layer of the first multilayer printed circuit board being grounded with the first grounding terminal and electrically connected to the first grounding component; and a second connector installed on a docking station for connecting with the first connector, the second connector comprising:

a second base;

a second terminal set installed on the second base for contacting with the first terminal set so as to transmit signals between the host device and the docking station with the first terminal set when the host device is docked in the docking station, the second terminal set comprising a second grounding terminal electrically connected to a grounding end of the docking station;

a second grounding component installed on the second base for contacting with the first grounding component so as to ground with the first grounding component when the host device is docked in the docking station, the second grounding component comprising a plurality of metal clip structures protruding out of the second base for abutting against the first grounding component; and a second multilayer printed circuit board installed on the second base, a grounding layer of the second multilayer printed circuit board being grounded with the second grounding terminal and electrically connected to the second grounding component.

2. The connector structure of claim 1, wherein the second terminal set is a pogo pin set.

3. The connector structure of claim 1, wherein at least one positioning hole is formed on the first base and at least one positioning post is formed on the second base for inserting inside the positioning hole of the first base so as to fix the first connector with the second connector.

4. A computer system comprising:

a docking station comprising a grounding end;

a host device docked in the docking station in a detachable manner, the host device comprising a grounding end; and a connector structure for transmitting signals between the docking station and the host device, the connector structure comprising:

a first connector installed on the host device, the first connector comprising:

a first base;

a first terminal set installed on the first base, the first terminal set comprising a first grounding terminal electrically connected to the grounding end of the host device;

a first grounding component installed on the first base, the first grounding component being a plate-shaped structure made of metal material for engaging with the first base; and a first multilayer printed circuit board installed on the first base, a grounding layer of the first multilayer printed circuit board being grounded with the first grounding terminal and electrically connected to the first grounding component and a second connector installed on the docking station for connecting with the first connector, the second connector comprising:

a second base;

a second terminal set installed on the second base for contacting with the first terminal set so as to transmit signals between the host device and the docking station with the first terminal set when the host device is docked in the docking station, the second terminal set comprising a second grounding terminal electrically connected to the grounding end of the docking station;

a second grounding component installed on the second base for contacting with the first grounding component so as to ground with the first grounding component when the host device is docked in the docking station, the second grounding component comprising a plurality of metal clip structures protruding out of the second base for abutting against the first grounding component[[.]]; and a second multilayer printed circuit board installed on the second base, a grounding layer of the second multilayer printed circuit board being grounded with the second grounding terminal and electrically connected to the second grounding component.

5. The computer system of claim 4, wherein the second terminal set is a pogo pin set.

6. The computer system of claim 4, wherein at least one positioning hole is formed on the first base and at least one positioning post is formed on the second base for inserting inside the positioning hole of the first base so as to fix the first connector with the second connector.

* * * * *